United States Patent [19]

Reddy

[11] 4,314,538

[45] Feb. 9, 1982

[54] ELECTRONIC FUEL CONTROL SYSTEM INCLUDING ELECTRONIC MEANS FOR PROVIDING A CONTINUOUS VARIABLE CORRECTION FACTOR

[75] Inventor: Junuthula N. Reddy, Troy, Mich.

[73] Assignee: The Bendix Corporation, Southfield, Mich.

[21] Appl. No.: 445,411

[22] Filed: Feb. 25, 1974

Related U.S. Application Data

[63] Continuation of Ser. No. 226,498, Feb. 15, 1972, which is a continuation-in-part of Ser. No. 101,896, Dec. 28, 1970, Pat. No. 3,734,068.

[51] Int. Cl.[3] ..... F02B 3/00

[52] U.S. Cl. ..... 123/485; 123/483; 123/484

[58] Field of Search ..... 123/478, 483, 484, 485

[56] References Cited

U.S. PATENT DOCUMENTS

| | | | |
|---|---|---|---|
| Re. 29,060 | 12/1976 | Reddy | 123/485 |
| 3,727,081 | 4/1973 | Davis et al. | 123/485 |
| 3,734,068 | 5/1973 | Reddy | 123/478 |
| 3,742,919 | 7/1973 | Suda | 123/478 |

*Primary Examiner*—Ronald B. Cox

*Attorney, Agent, or Firm*—Russel C. Wells; Gerald K. Flagg

[57] ABSTRACT

An electronic fuel control system of the type providing fuel delivery controlling signals during the period of time that at least a portion of a controlled signal maintains a preselected relationship with respect to particular value is provided with circuit means for continuously providing a variable correction factor. The injection controlling signal is produced by generating a time varying voltage which varies in a predetermined fashion following the occurrence of a triggering event. The generated voltage signal has a first or correction portion and a second or injection controlling portion. The magnitude of the first portion is modulated as a function of the time elapsed from the most recently to have occurred triggering event to provide accurate information to controllably affect fuel delivery. The circuitry of the present invention provides a plurality of voltage level establishing means which may be sequentially operable to establish a maximum charge on the timing capacitor and further includes controllable energy discharge means to vary the control charge from a higher to a lower value. In addition, further switching means are illustrated to controllably sequence the application of the circuitry of the present invention between selected ones of a plurality of timing capacitors which are to be sequentially operated.

13 Claims, 5 Drawing Figures

ELECTRONIC FUEL CONTROL SYSTEM INCLUDING ELECTRONIC MEANS FOR PROVIDING A CONTINUOUS VARIABLE CORRECTION FACTOR

CROSS REFERENCE TO RELATED APPLICATIONS

This is a continuation of application Ser. No. 226,498 filed Feb. 15, 1972 now pending. The present application is also related to my co-pending, commonly assigned patent application Ser. No. 226,486, "RPM Information Signal Generating Circuitry for Electronic Fuel Control System" filed concurrently herewith on Feb. 15, 1972 and is a Continuation-in-part of my United States patent application Ser. No. 101,896 filed on Dec. 28, 1970 and issued on May 22, 1973 as U.S. Pat. No. 3,734,068 on a "Fuel Injection Control System."

BACKGROUND OF THE INVENTION

1. Field of the Invention

The present invention is related to the field of fuel control systems for providing metered quantities of fuel to a power producing engine. More specifically, the present invention is related to that portion of the above-noted field in which fuel is provided in response to accurately timed electrical pulses. More particularly, the present invention is related to that portion of the above-noted field which is concerned with the generation of the accurate electrical pulses. In particular, the present invention is related to that portion of the above-noted field in which an electrical pulse is generated during the period of time that at least a portion of a controlled voltage waveshape maintains a selected relationship with respect to a selected value. The present invention is specifically related to that portion of the above-noted field in which the controlled voltage waveshape has a first portion for introducing a control parameter and a second portion following immediately thereon for controlling generation of the electrical pulse. In a fuel control system in which the electrical pulses are generated while the second portion of the waveshape remains below a threshold value, the present invention is concerned with providing continuously variable control of the first portion of the waveshape to modulate the initial value of the second portion to thereby controllably affect the period of time that the second portion remains below the threshold value.

2. Description of the Prior Art

My co-pending commonly assigned patent application Ser. No. 219,275 entitled "Circuit For Providing Electronic Full-Load Enrichment Fuel Compensation In An Electronic Fuel Control System" filed on Jan. 20, 1972, describes one method by which the initial value of the second portion of the controlled voltage/waveshape may be modulated. The method shown and described therein is adequate provided no more than two levels of controlled voltage are desired and further provided that the corrective factor is changing from a lower to a higher value for decreases in engine rpm. By "corrective factor" or "correction factor" is meant that value which the first portion of the controlled waveshape must maintain for various rpm values to provide an initial value to the second portion of the controlled waveshape to produce an output electrical signal of a duration which is accurate for the engine speed.

If greater numbers of different corrective factors are required, or if the sequence of corrective factors does not permit a continually increasing or continually decreasing corrective factor for changing engine speeds the circuitry illustrated in my co-pending application is not effective. Furthermore, using the design philosophy embodied in that circuitry would require extensive additional circuitry to add in additional corrective factors even for smoothly varying factor changes. It is therefore an object of the present invention to provide circuitry for generating rpm corrective values which may have a plurality of stable or uniform levels and which may switch between the various levels in response to variations in engine speed. More particularly, it is an object of the present invention to provide such a system which is capable of providing three or more corrective factor levels in a simple and easy to implement fashion which will not unduly burden the electronics of the system. It is a still further object of the present invention to provide such a system in which switching between the various corrective factor levels may be readily accomplished irrespective of the sequence of change of the corrective factors.

An associated problem which has been treated in my co-pending commonly assigned patent application docket number MOC 70/75 and titled "RPM Information Signal Generating Circuitry for Electronic Fuel Control System" had to do with the generation of knowledge as to the precise engine speed. The solution to this problem resulted in the design of electronic circuitry which would respond to engine speeds by determining whether or not the period of time following an engine triggering event was shorter or longer than the time period associated with engine speed at selected rpm values. By "triggering event" is meant the signal, or the condition of engine operation giving rise to the signal, which is used to indicate at least one selected angle of engine crank shaft rotation. With the capability of generating rpm information as one or more electrical signals whose presence or absence could be interpreted to yield a range of speeds within which the instantaneous engine operation would exist, it therefore becomes an object of the present invention to provide electronic circuitry which is capable of receiving such information and generating the desired corrective factors as a function of the information received. In view of the fact that it has been determined that accuracy considerations require nearly current rpm information it is also an object of the present invention to provide circuitry for continuously generating an accurate correction factor in response to a signal or signals indicative of engine speed.

SUMMARY OF THE PRESENT INVENTION

The present invention provides electronic circuitry to controllably regulate, on a prescheduled basis, the generation of a portion of the controlled waveshape signal. The circuitry of the present invention receives signals indicative of the range of speed within which the associated engine is operating and generates as output a signal having a magnitude dependent upon the input signals. The circuitry of the present invention comprises a plurality of reference level means for generating voltage signals, at least one of which is switchable between first and second levels with the first level being lower than, and the second level being higher than, a selected magnitude and including means for generating a voltage signal having the selected magnitude. Regulating means are arranged to be responsive to the generated voltage signals and to respond to a selected extreme voltage (highest or lowest) to regulate a further sensed voltage to the value of the then existing selected extreme. In a presently preferred embodiment, the regulating means are operative to regulate the voltage appearing on a timing capacitor to a value which corresponds to the value of the lowest of the signals generated by the reference level means. In addition, switching means are illustrated to switch the circuitry of the present invention between ones of a plurality of timing capacitors. The present invention also includes energy discharging means to enable the timing capacitors to be controllably discharged from relatively higher levels of voltage to relatively lower levels of voltage and also included are means to control the rate of such discharges.

In the presently preferred embodiment, the regulating means and the reference level means are interconnected in an emitter-coupled transistor configuration. By controlling the reference level means to selectively alter the various voltage level signals, the selected extreme (maximum or minimum) voltage can be arranged to be representative of the desired voltage on the timing capacitor from moment to moment. In the hereinbelow described embodiment, the reference level establishing means are arranged to generate a low level of signal while the input signals to the reference level establishing means are indicative of a predetermined range of possible engine speeds and this voltage output signal is then forced or driven to a substantially higher value for other ranges of engine speed. This higher value can readily be arranged, according to the teachings herein, to be higher than the low values generated by the other reference level establishing means. By selectively shorting a resistor in a voltage divider with a transistor which is responsive to the appropriate input signal a combination of signals, the voltage applied to the emitter-coupled transistor configuration may be appropriately raised or lowered. This provides a convenient mechanism for generating the desired number of control levels for the first portion of the controlled waveshape by which a further level may be added by adding a further reference level establishing means having a low level signal indicative of the additional control level. In the context of this description "signal" is intended to mean the controlled absence of a voltage or the controlled presence of a voltage in response to predetermined operating conditions on parameters. In the presently preferred embodiment, the present invention is therefore capable of providing the proper initial voltage value for a timing capacitor in response to engine speed as an automatic function.

DETAILED DESCRIPTION OF THE DRAWING

Figure 1:
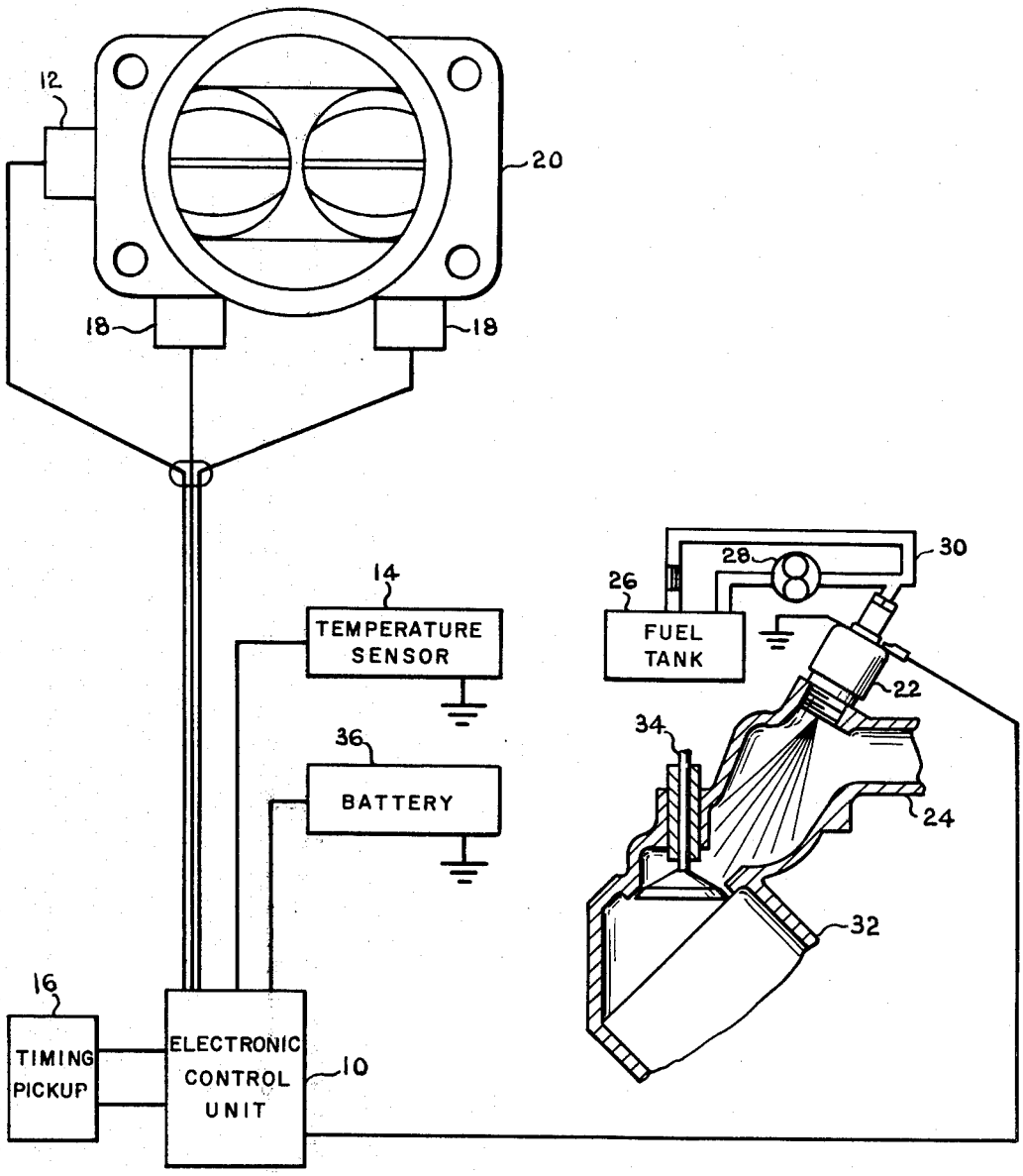
FIG. 1 shows, in diagramatic form, an electronic fuel control system for an internal combustion engine with which the present invention is of utility.

Referring now to FIG. 1, an electronic fuel control system is shown in diagramatic form. The system is comprised of a main computing means or electronic control unit 10, a manifold pressure sensor 12, a temperature sensor 14, an input timing means 16 and various other sensors denoted as 18. The manifold pressure sensor 12 and the associated other sensors 18 are illustrated mounted on throttle body 20 but it will be understood that other mounting locations are possible. The output of the computing means 10 is coupled to an electromagnetic injector valve member 22 mounted in intake manifold 24 and arranged to provide fuel from tank 26 via pumping means 28 and suitable fuel conduits 30 for delivery to a combustion chamber 32 of but one of several forms of an internal combustion engine, otherwise not shown. While the injector valve member 22 is illustrated as delivering a spray of fuel toward an open intake valve 34, it will be understood that this representation is merely illustrative and that other delivery arrangements are known and utilized. Furthermore, it is well known in the art of electronic fuel control systems that computing means 10 may control an injector valve means comprised on one or more injector valve members arranged to be actuated singly or in groups of varying numbers in a sequential fashion as well as simultaneously. The computing means is shown as energized by battery 36 which could be a vehicle battery and/or battery charging system as well as a separate battery.

Figure 2:
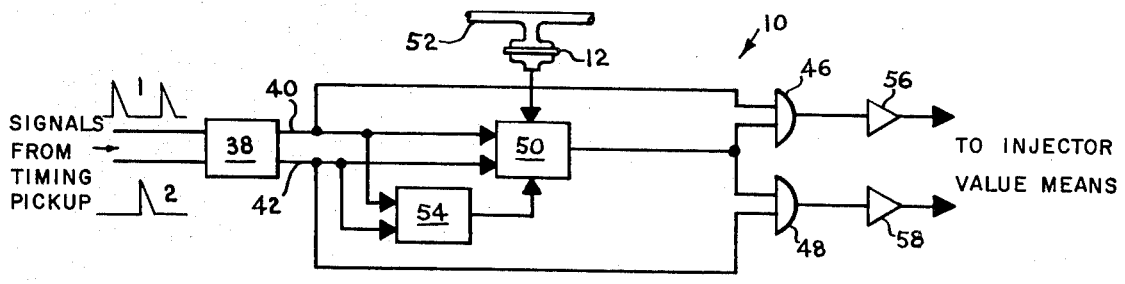
FIG. 2 shows a block diagram of one form of electronic control unit for use in the system of FIG. 1.

The block diagram shown in FIG. 2 illustrates the computing means 10 in a nonparticularized manner as applied to two-group injection. In FIG. 2, there is shown a switching device 38 capable of producing alternating output signals and receiving as input a signal or signals representative of engine crank angle as from sensor 16. Mechanically, sensor 16 could be a single-lobed cam, driven by the engine and alternately opening and closing a pair of contacts. Since this arrangement could generate spurious signals, as by contact bounce, the switching device 38 will be described and discussed as a flip-flop since the flip-flop is known to produce a substantially constant level of output at one output location and zero level at the other output location in response to a triggering signal which need only be a spike input as illustrated by traces 1 and 2 but may also be of longer duration and a flip-flop may be readily made insensitive to other types of signals. Signals received on the nontriggering input will, of course, have no effect on a flip-flop. Output conductors 40 and 42 are connected to the input of unit 50. Output conductors 40 and 42 are also connected to the inputs of a pair of AND gates with output conductor 40 being connected to one input of AND gate 46 and the output conductor 42 being connected to one input of AND gate 48. Unit 50 receives, as primary control input, signals from the pressure sensor 12 indicative of an engine operating condition and, therefore, of the engine fuel requirement. Sensor 12 is here shown coupled to a manifold lead or runner 52. The actual location of sensor 12 will depend upon the dynamic characteristics of the intake manifold and throttle body. Unit 50 also receives a signal from the rpm information signalling means 54 which is arranged to also receive the triggering signals from output conductors 40, 42. The output of the unit 50 is connected to a second input of each AND gate 46 and 48. The output of AND gate 46 is connected to amplifier 56 which, in turn, supplies controlling current to the first injector group. AND gate 48 is connected to amplifier 58 which supplies controlling current to the second injector group. For the sake of simplification, the additional control inputs have been omitted.

As will be readily apparent, the presence of an output signal from the flip-flop 38 will occur at one output location to the exclusion of the other. This signal will then appear at one input of only one AND gate of only one amplifier. This signal selectively designates an injector or injector group for imminent injection. For the sake of example, it may be assumed that the output signal of the flip-flop 38 is at output location 40 so that the signal also appears at one input of AND gate 46. The signal from the output 40 of the flip-flop 38 also appears at the unit 50 as well as the rpm information signalling means 54. Unit 50 is operative to produce an output during the passage of a predeterminable amount of time. This time is determined by the values of the sensory input applied to unit 50 as well as by the input provided by the rpm information signalling means 54. During this initial period of time the output of the unit 50 is providing a full-strength output signal. This signal is applied to one input of each of the AND gates 46 and 48. Because of the intrinsic nature of AND gates, an output signal is produced only while an input signal is being applied to each and every input. This then dictates that AND gate 46 will produce an output to be amplified by amplifier 56 to open the first injector group since it is receiving an injector selection command directly from the flip-flop 38 and an injector control command from the unit 50. At the end of the time delay period, unit 50 produces a zero level signal so that the injection control command output signal is removed from the input to the AND gate 46 and the output of the AND gate 46 goes to zero, thereby allowing the first injector group to close. During the period of time the first injector group is open, a metered amount of fuel under pressure is injected by the first injector group. Depending upon particular electronics selected, suitable amplifiers and/or inverters may be used to match obtainable signals with desired or necessary circuit responses.

Figure 3:
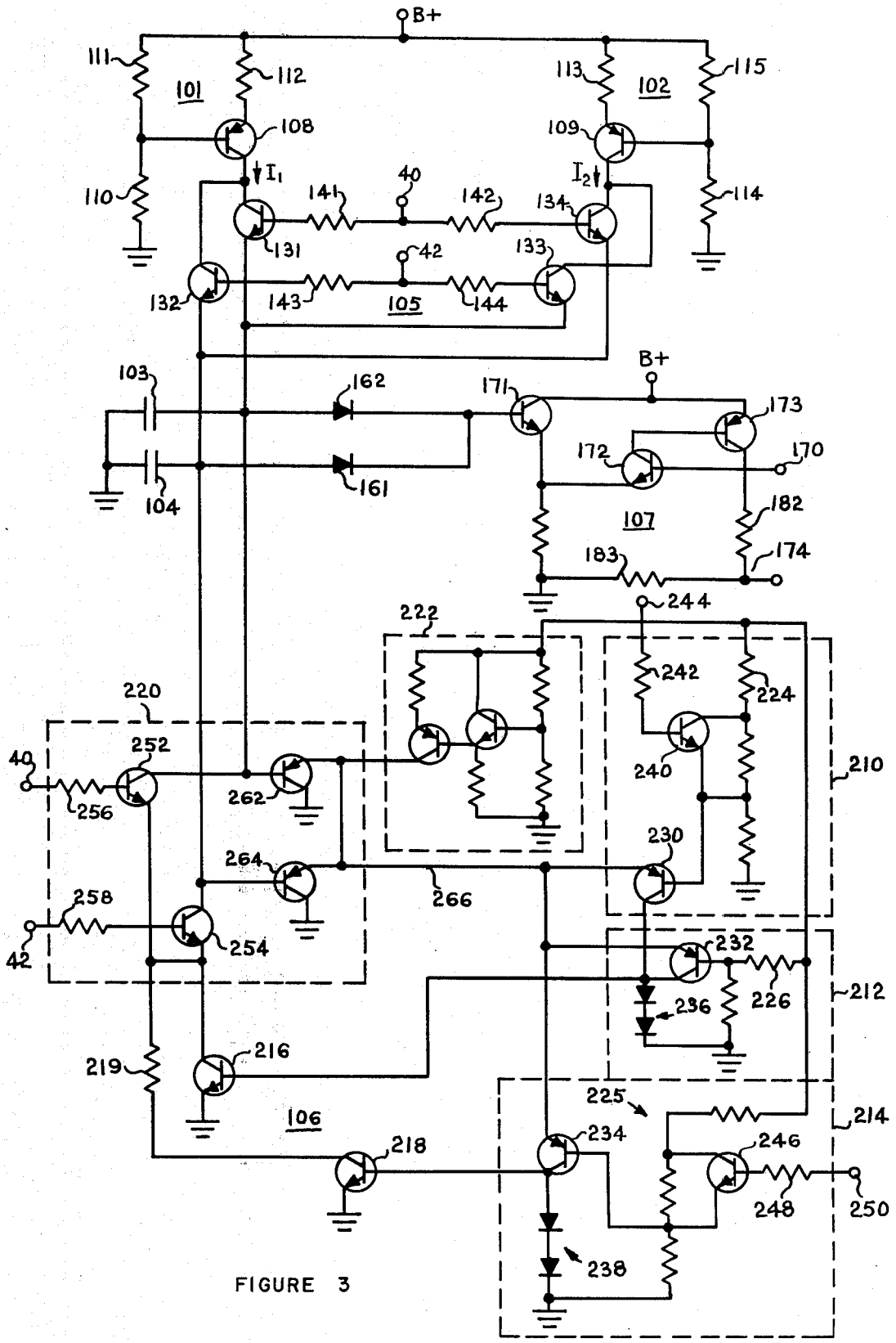
FIG. 3 shows an electronic circuit realization according to the present invention of a portion of the electronic control unit of FIG. 2.

Referring now to FIG. 3, an electronic circuit incorporating the present invention is illustrated to satisfy the functional requirements of block 50 in the block diagram of FIG. 2. The unit 50 is comprised of a pair of current sources 101, 102 which are alternately applied to a pair of timing capacitors 103, 104 by a switching network 105 receiving the triggering signals 40, 42. Also receiving triggering signals 40, 42, network 106 controls the level of the voltage on the selected capacitor 103, 104 prior to generation of the injection command signal. Threshold establishing circuit means 107 samples the highest voltage appearing across capacitors 103, 104 and compares this value with the level established by the signal received from pressure sensor means 12 at input port 170 to compute the fuel injection command signal.

The current source 101 is comprised of transistor 108 whose base is connected to the junction of a pair of voltage dividing resistors 110, 111 and whose emitter is connected to resistor 112. The resistors 111 and 112 are connected to a source of potential identified as B+ and resistor 110 goes to ground. Current source 102 is similarly comprised of a transistor 109 whose base is coupled to the junction of voltage divider resistors 114, 115 and whose emitter is connected to resistor 113 which is also connected to the B+ source. This arrangement is operative to establish a known level of current flow in the collectors of transistors 108, 109, respectively. The collector of transistor 108 is then connected in a parallel fashion to the collectors of a pair of transistors 131, 132. Similarly, the collector of transistor 109 is connected in parallel to the collectors of a pair of transistors 133, 134. The bases of transistors 131 and 134 are connected together through resistances 141, 142 while the bases of transistors 132, 133 are connected by way of resistances 143, 144. The junction of resistances 141, 142 is arranged to receive the trigger signals from output 40 while the junction of resistances 143, 144 is arranged to receive the trigger signals from output 42. The emitters of transistors 131 and 133 are connected to capacitor 103 while the emitters of transistors 132 and 134 are connected to capacitor 104. This circuit is then arranged to provide the current flow from current source 101 through transistor 131 to capacitor 103 and the current from source 102 through transistor 134 to capacitor 104 whenever a high voltage signal appears on output 40 and a low voltage signal appears on output 42. Whenever a low voltage signal is present on output 40 and a high voltage signal is present on output 42, the current from source 101 will flow through transistor 132 to capacitor 104, while the current from source 602 flows through transistor 133 to capacitor 103.

The threshold establishing circuit receives a signal indicative of the manifold pressure at 170 and this signal is applied to the base of transistor 172. The base of transistor 171 receives by way of diodes 161, 162 the signal from the one of capacitors 103, 104 whose accumulated charge, or voltage, is highest. As the emitters of transistors 171, 172 are coupled together, one of these transistors will be in conduction depending upon which has a base residing at a higher voltage value. When the value appearing on the base of transistor 171 exceeds the value appearing on circuit input 170, transistor 171 will go into conduction and transistor 172 will drop out of conduction. Termination of conduction of transistor 172 will consequently terminate conduction of transistor 173. While transistor 172 was conducting, transistor 173 was also conducting and a relatively high voltage signal was present at circuit location 174 due to the voltage divider action of resistors 182, 183. However, termination of conduction of transistor 173 will result in a substantially zero or ground level signal appearing at circuit location 174 due to the lack of current flow through the resistors 182, 183. This output signal may be applied to the OR gates 46, 48 in the FIG. 2 embodiment to constitute an injection command signal.

According to the present invention, the timing capacitor discharging and initial charge controlling circuitry 106 is comprised of a plurality of reference level establishing means 210, 212, and 214, a pair of discharging means 216, 218, switching means 220 and a current source means 222. The reference level establishing means 210, 212, and 214 are connected to the source of energy indicated as B+ and are comprised of voltage divider means 224, 226, and 228, respectively, and voltage signal communicating transistor means 230, 232, and 234 respectively. The voltage communicating transistor means 230, 232 and 234 are arranged to have their bases communicated to a portion of the voltage divider means so that a known level of voltage may appear thereon and their emitters are connected to a common point. The collectors of the transistors 230 and 232 are coupled together and are communicated to ground through a diode means 236 while the collector of transistor 234 is communicated to ground through a separate diode means 238. The collector/diode junction of the transistors 230, 232 and diode means 236 is communicated to the discharging means 216 while the collector/diode junction of transistor 234 and diode means 238 is communicated to the discharging means 218.

Reference level establishing means 210 further includes a transistor 240 whose collector and emitter terminals are arranged to shortcircuit at least a portion of the voltage divider means 224 when the transistor is in conduction. The base of transistor 240 is coupled to resistance 242 which is in turn coupled to external terminal 244. Similarly, reference level establishing means 214 includes a transistor 246 arranged in short circuit relationship to at least a portion of the voltage divider means 228. Resistance 248 appears in the base circuit 246 and this is communicated to external terminal 250.

Energy dissipating means 216 and 218 are here illustrated as transistor elements having their emitter electrodes connected to ground and their base electrodes connected to the collectors, respectively, of transistor members 232 and 234. The collector of transistor 216 is coupled to switching means 220 while the collector of transistor 218 is coupled to resistance 219 which is in turn coupled to switching means 220.

The switching means 220 is comprised of a pair of transistors 252, 254 having resistors 256 and 258 in their base circuits. Resistor 256 is further connected to terminal 40 and resistor 258 is connected to terminal 42. The emitters of the transistors 252 and 254 are coupled together through circuit connection 260 and this common circuit connection is in turn connected to the energy dissipating means 216 and 218. In the illustrated embodiment this is accomplished by connecting the collector of transistor 216 to the common junction and the collector of transistor 218 through further resistor 219 which is then connected to the common junction 260. The collector of each of the switching transistors 252, 254 is coupled to the base of a regulating transistor 262, 264 respectively and each of these collector-base connections is connected to one of the two timing capacitors 103, 104 so that switching transistor 252 is coupled to regulating transistor 262 and also to timing capacitor 103 while switching transistor 254 is coupled to regulating transistor 264 and also to timing capacitor 104.

The regulating transistors 262, 264 and the controlled regulation transistors 230, 232 and 234 are intercoupled in a common-emitter configuration by common circuit location 266 coupled directly to each of the emitters of the five above enumerated transistors. Each of the five transistors is illustrated as being a pnp transistor with the regulating transistors 262, 264 having their collectors connected to ground and the controlled regulation transistors 230, 232 and 234 having their collectors connected to ground through a diode means which is here illustrated as the pairs of diodes identified as 236 and 238.

Current source means 222, which is herein illustrated as a conventional transistorized current source, is operative to provide a known level of current to the common circuit location 272. As is known in the art, the configuration comprising the transistors 230, 232, 234, 262, and 264 each having a voltage signal applied to the base thereof will have only those transistors in conduction which have the lowest identical base voltage. In the event that there is a single base residing at a lowest potential, that transistor and only that transistor will be in conduction and all others will be turned off due to the fact that the common emitters will be residing at a potential which is one pn junction above the value of the lowest base voltage and this value will be insufficient to forward bias any other emitter-base junctions.

The circuit as illustrated is arranged to provide the lowest voltage potential at the base of controlled regulation transistor 232 when signals are present on each of the input terminals 244, 250. In such a configuration, and assuming a varying voltage appearing across both the timing capacitors 103, 104, whenever the potential appearing across the appropriate one of the timing capacitors becomes identical with the voltage appearing on the base of the controlled regulation transistor 232, the regulating transistor which is coupled to the appropriate timing capacitor will begin to conduct so as to maintain that timing capacitor at the potential then appearing on the base of transistor 232. By suitably arranging the various resistive values within the voltage divider resistive networks 224, 226 and 228, it can be arranged that the base of the controlled regulation transistor 232 will be at a value lower than the base of either of controlled regulation transistors 230, 234 while the shorting transistors 240 and 246 are switched on and will be at a higher value than at least one of the bases of controlled regulation transistors 230, 234 while either of shorting transistors 240 and 246 is not conducting. Furthermore, it can be arranged that the lowest voltage appearing at any of the three bases 230, 232, 234 may be sequentially varied by controlling the conductive states of the shorting transistors through the signals applied to the external terminals 244, 250.

Figure 4:
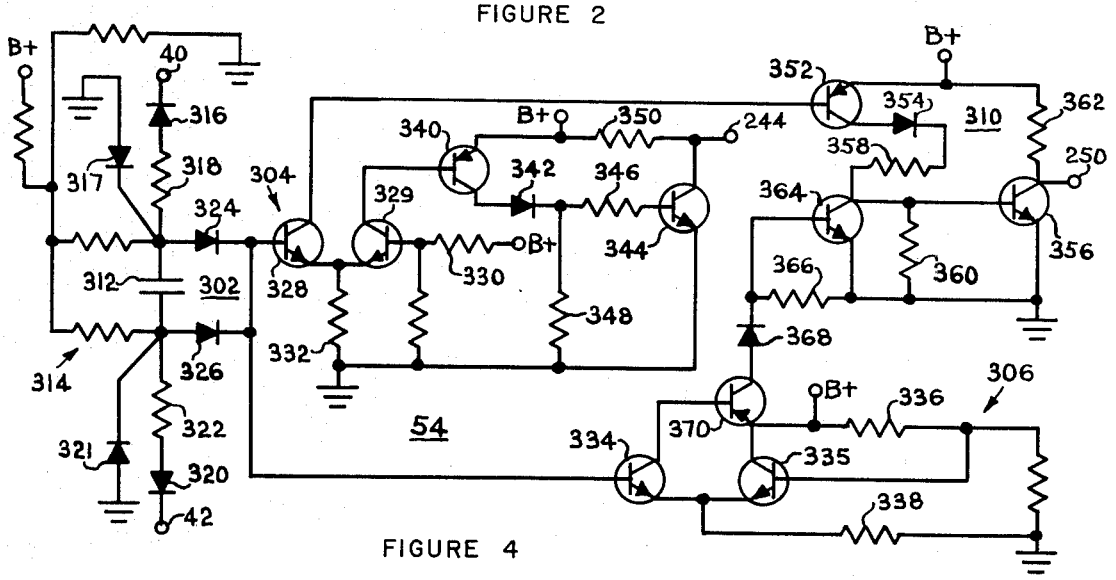
FIG. 4 shows an electronic circuit realization according to FIG. 2 and for utilization with the circuit of FIG. 3.

Referring now to FIG. 4, a circuit is illustrated for generating rpm information in a presently preferred embodiment to selectively control the voltage appearing at the external terminals 244, 250 of the circuit 300 of FIG. 3. The circuit is comprised of a triggering section 302, a plurality of switching sections 304, 306 and a plurality of signal generating means 308, 310. The triggering section is centered about capacitor 312 and further comprises resistive means 314 providing a voltage divider between the source of energy B+ and the ground as indicated for each terminal of capacitor 312. Input signalling leads comprising a diode and resistor also intercommunicate each terminal of capacitor 312 with the triggering output conductors 40 and 42. For example, diode 316 and resistance 318 intercommunicate the output conductor 40 with one side of capacitor 312 while diode 320 and resistance 322 intercommunicate the other side of capacitor 312 with the output conductor 42. Each side of capacitor 312 is also communicated to the bases of two transistors in the switching sections 304, 306 by further diodes 324, 326.

The switching section 304 is comprised of an emitter coupled pair of transistors 328, 329, and a reference voltage divider means 330. The emitter coupled pair of transistors are comprised of a pair of npn transistors having their emitters coupled to a further resistance 332 going to ground and having the collector of transistor 329 coupled to signal generating means 308 and the collector of transistor 328 coupled to signal generating means 310. The switching section 306 is similarly comprised of an emitter coupled pair of transistors 334, 335 and a reference voltage divider means 336. The emitter coupled pair of transistors have their emitters coupled to a further resistance 338 going to ground while the collector of transistor 335 is coupled to the B+ source of energy and the collector of the transistor 334 is coupled to the signal generating means 310.

Signal generating means 308 is comprised of transistor 340 whose base is coupled to the collector of transistor 329 and whose emitter is connected to the B+ source of energy. The collector of transistor 340 is coupled to anode of diode 342 whose cathode communicates with the base of transistor 344 through resistance 346. The cathode of diode 342 is also coupled to ground through resistance 348. The collector of transistor 344 is connected to the source of B+ supply through resistance 350 and the junction formed by resistance 350 and the collector of transistor 344 is then communicated to terminal 244 so that, in the presence of a current flow through transistor 344 the signal present on terminal 244 will be substantially the ground or low level signal and in the absence of current flow through transistor 344 the terminal 244 will be at a relatively high voltage value near the B+ supply.

Similarly, signal generating means 310 is comprised of an input transistor 352 whose emitter is connected to the B+ source of supply and whose base is communicated to the collector of transistor 328. The collector of transistor 352 is connected to the anode of diode 354 while the cathode of diode 354 is coupled to the base of output transistor 356 through resistance 358. The cathode of the diode 354 is also coupled to ground through resistance 360. The collector of transistor 356 is coupled to the B+ source of supply through resistance 362 and the junction formed between the collector of transistor 356 and the resistance 362 is communicated to the terminal 250. Signal generating means 310 also includes a further transistor 364 which is arranged to shortcircuit the resistance 360. The base of transistor 364 is coupled to resistance 366 and the cathode of diode 368 while the emitter of transistor 364 is connected to ground as is the other side of resistance 366. The anode of diode 368 is connected to the collector of transistor 370 whose base is coupled to the collector of transistor 334 within the switching section 306 and whose emitter is connected to the B+ source of supply.

Figure 5:
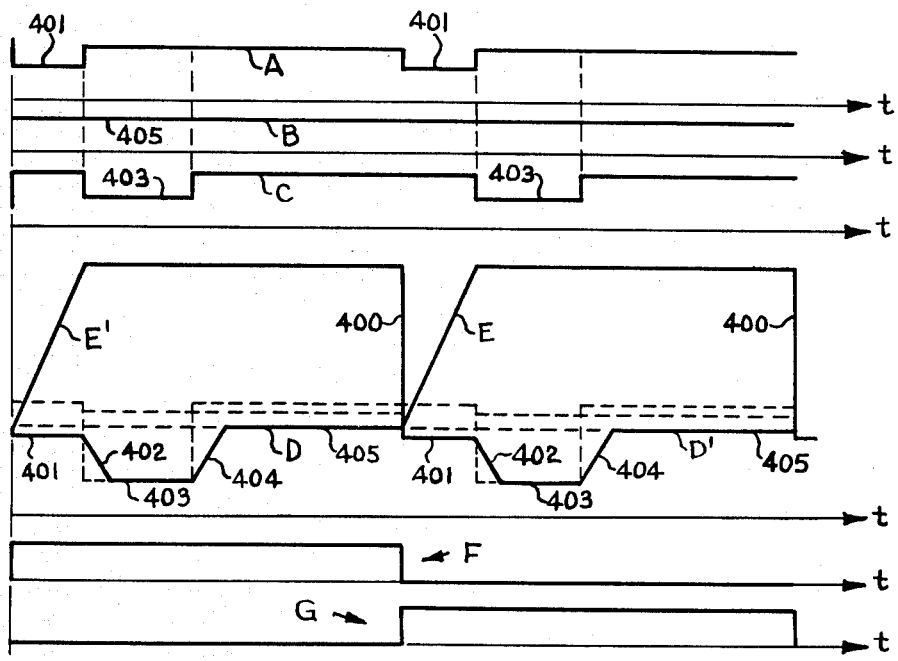
FIG. 5 illustrates a series of voltage wave forms which illustrate the operation of the FIGS. 3 and 4 circuit diagrams.

Referring now to FIGS. 3, 4 and 5 the operation of the present invention will be illustrated. Receipt of a triggering signal on the appropriate input lead will result in the signals on output conductors 40 and 42 to be substantially as illustrated in FIG. 5. That is to say a relatively high signal will appear on conductor 40 and a ground or zero level signal will appear on conductor 42. The zero level signal received on lead 42, when applied to the appropriate terminals of the circuit of FIG. 3, will be operative to turn off the various transistors which are in communication through their control electrode with the conductor 42 (for example transistors 132, 133, and 254). The presence of the high voltage signal on lead 40 will be operative to turn on those transistors whose control electrodes are in communication with the lead 40 (for example transistors 131, 134 and 252). Thusly, the current identified as $I_1$ will be applied to the timing capacitor 103 while the current identified as $I_2$ will be communicated to the timing capacitor 104. Also, the timing capacitor 103 will be communicated by way of transistor 252 to the common circuit connection 260. The preceding cycle of operation of this system will have provided the timing capacitor 103 with a relatively high voltage at the instant of switching. This voltage is communicated to the base of transistor 262 while the voltage then appearing on timing capacitor 104 which is some lower value is communicated to the base of transistor 264. Immediately following a triggering event, a current will be flowing through the diode means 236 from the reference level establishing means 210 as described hereinbelow. The presence of this current flow will be operative to turn energy dissipating transistor 216 on. This transistor, being turned on and communicated to the common circuit point 260, will be operative to dump the voltage then appearing on timing capacitor 103 and the voltage on the base of transistor 262 will drop. As this voltage approaches the voltage appearing on the base of the one transistor of the pair of transistors 230 which is providing the current flow through the diode means 236, this transistor will begin to turn off and the transistor 262 will begin to turn on due to their common emitter configuration. This switching off of the transistor 230 will result in the switching off of the transistor 216 and the voltage appearing on the timing capacitor 103 will then be regulated to the lowest voltage then appearing on the bases of transistors 230, 232, and 234. Since this initial phase of regulation will occur within the nominal switching time of electronic devices (which is known to be quite short) the voltage on the capacitor 103 will be regulated to the value of the portion 401 of the curve D of FIG. 5. Continued current flow of $I_1$ in the direction of timing capacitor 103 will flow to ground through the transistors 252 and 216.

The presence of a high voltage signal on lead 40 will have no effect upon the circuit of FIG. 4 since it will be blocked from transmittal to capacitor 312 by the diode member 306. However, the presence of a low voltage signal on input lead 42 will have the effect of drawing the side of capacitor 312 which is coupled to lead 42 to a very low near ground potential. The other side of capacitor 312 which was near ground during the preceding phase of operation will be held near ground by diode 317. The transistors 329 and 335 will go into conduction due to the presence of the relatively high voltage signals appearing on their bases. The conduction of transistor 329 will be operative to cause transistor 340 to conduct providing a base current flow to transistor 344 through diode 342 to resistance 346 causing transistor 344 to go into conduction. This will generate a relatively low, near ground, level signal on terminal 244 causing transistor 240 in the reference level establishing means 210 to be nonconductive. This will cause the voltage divider means 224 to establish a low level voltage signal on the base of transistor 230 which, by suitable arrangement of the resistive elements within the voltage divider networks 224, 226, 228 can be arranged to cause the base of transistor 230 to be at a potential lower than that of the bases of transistors 232 and 234.

While transistors 328 and 334 are nonconductive, the transistors whose bases are coupled to the collectors of the nonconductive transistors 328 and 334 (transistors 352 and 370) will also be nonconductive. This will cause transistor 356 to be nonconductive and the voltage appearing on terminal 250 will be a relatively high voltage. This relatively high voltage applied through resistance 248 to the base of transistor 246 will be operative to cause transistor 246 to be conductive thereby shortcircuiting a portion of the voltage divider means 228 and applying a relatively high level of voltage signal to the base of transistor 234.

As the charge appearing across capacitor 312 begins to increase, the voltage applied to the bases of the nonconductive transistors 328, 334 will begin to increase.

When this voltage reaches the switching levels established by the voltage divider means 330 and 336, the conductive state of the transistors within the two emitter coupled pairs will reverse. By suitably arranging the voltage dividers 330 and 336, the emitter coupled pair of transistors comprised of transistors 328 and 329 can be arranged to switch its conductive state earlier in time than the emitter coupled pair of transistors comprised of transistors 334 and 335. This can be accomplished by making the base voltage on transistor 329 lower than the base voltage on transistor 335 so that the charge across capacitor 312 as it increases will reach the value on the base of transistor 329 prior to the point in time when it reaches the value on the base of transistor 335. Upon switching of the current flow from transistor 329 to transistor 328, the transistor 340 will drop out of conduction while the transistor 352 begins to conduct. This will have the effect of turning off transistor 344 and turning on transistor 356. This will cause the voltage appearing on terminal 244 to increase and the voltage appearing on terminal 250 to decrease. This will establish the fact that engine rpm is less than the rpm associated with the time period required for capacitor 312 to charge to the value represented by the voltage divider 330. The effect of this upon the reference level establishing means 210 and 214 will be to switch on the transistor 240 and to switch off the transistor 246 so that the voltage appearing at the base of transistor 234 to decrease. Again by suitable arrangement of the various resistive values the voltage at the base of transistor 234 can be arranged to be lower than the voltage at the base of either of transistors 230, 232.

Assuming that the actual engine rpm value is relatively low so that the period of time between successive triggering events is relatively long, the charge across capacitor 312 will continue to increase until such time as it reaches a value established by the voltage divider 336 indicative of engine rpm lower than a second predetermined value. The current flow will then switch from transistor 335 to transistor 334 and transistor 370 will be switched on. This will provide a current flow through diode 368 to the transistor 364 within the signal generating means 310 providing a shortcircuit for current flow from transistor 352. The effect of this shortcircuit will be to prevent base current from entering the base of transistor 356 thereby turning that transistor off and causing the voltage signal appearing at terminal 250 to increase from the low or near ground level signal to a relatively high signal thereby establishing the second rpm break point. This increase of voltage at the terminal 250 of the reference level establishing means 214 will be operative to trigger transistor 246 back into conduction thereby raising the voltage applied to the base of transistor 234. This increase in voltage at the base of transistor 234 coupled with the previous increase in voltage applied to the base of transistor 230 can readily be arranged through suitable selection of the resistive values in the voltage divider network 226 to render the base of transistor 232 lowest among the three so that the voltage appearing across the appropriate timing capacitor will be regulated to that value.

With specific reference now to FIG. 5, the curve identified as A represents the voltage applied to the base of transistor 230 as a function of time while the curve B represents the voltage applied to the base of transistor 232 as a function of time and the curve C represents the voltage applied to the base of transistor 234 as a function of time. The effect of the curves A, B, and C may be combined through the above described regulating action to produce the rpm correction waveform as shown in the graph representing the voltage applied to the timing capacitors. This voltage waveform is identified as D and represents the voltage applied to the timing capacitor 103 to provide desired rpm correction while the portion of the curve identified as E represents the voltage applied to the timing capacitor 103 (by current $I_2$) to generate the injection pulse. Waveforms D′ and E′ are also illustrated and represent the voltages appearing on the timing capacitor 104 during the same time period. The voltage waveforms F and G represent the triggering signals appearing on triggering conductors 40 and 42 respectively. It will be observed that the waveform D does not exactly coincide with the waveforms A, B, and C as waveform D contains ramp portions which occur at points in time coincident with the step functions.

The waveforms D and D′ are comprised of level portions identified as 401, 403, 405 and two sloped portions 402, 404. In addition, the transition from waveform E′ to successive waveform D′ is indicated by portion 400. The portion of the curve D identified as 401 is a voltage level corresponding to the lowest portion of the waveform A also identified as 401, the portion identified as 403 corresponds to the lowest portion of the waveform identified as C, also identified as 403, while the portion identified as 405 corresponds to the curve B. The sloped portion 402 represents the rate of decay of the accumulated charge on the timing capacitor through resistance 219 and transistor 218 and the slope of this portion is controlled by the value of resistance 219. The sloped portion 404 is controlled by the rate of charging of the appropriate timing capacitor provided by the current $I_1$. The near vertical portion identified as 400 represents the drop in the voltage across the appropriate timing capacitor as the value decreases from that represented by the curve E through that represented by the initial portion of the curve D as the accumulated charge is "dumped" through transistor 216. The curve E is generated by the current flow $I_2$ being applied through the appropriate switching transistors to the appropriate timing capacitor and is additive to the value of voltage across the appropriate timing capacitor at the point in time of switching.

We claim:

1. In an internal combustion engine fuel control system of the type having first and second sensor means for producing respective first and second sensor signals indicative of the variable magnitudes of respective first and second engine operating parameters, computing means responsive to said sensor signals to provide a fuel delivery command signal indicative of the engine fuel requirement, and fuel supply means responsive to the fuel delivery command signal to supply the engine with fuel in accordance with the fuel delivery command signals, the computing means operative in successive first and second computing portions and comprising at least one timing capacitor, first and second current sources for providing respective first and second currents, and a current source switch operative to communicate said first current source with the timing capacitor during said first computing portion and said second current source with said timing capacitor during said second computing portion, whereby the computing means controls the duration of the fuel delivery command signal in accordance with the time required for a control signal developed by the timing capacitor to vary at a predetermined rate from an initial value determined in accordance with said first engine parameter during the first computing portion to a threshold value determined in accordance with said second engine parameter during the second computing portion, the computing means including an improved circuit for establishing the initial value of the control voltage by regulating the instantaneous values of the control voltage at reference levels varying with the magnitude of said first engine parameter comprising:

(a) discharge switch means having ON and OFF conditions established during said first computing portion and comprising an input electrode connected to said timing capacitor, output electrode connected to a source of constant reference potential, and control electrode, said discharge switch means operative when established in said OFF condition to permit said first constant current source to apply said first current to said timing capacitor so as to vary said control voltage in one direction and operative when established in said ON condition to communicate said timing capacitor and said source of constant reference potential so as to vary said control voltage in the opposite direction;

(b) reference level generating means responsive to the magnitude of said first engine parameter to generate a reference level output varying within a said first computing portion with the magnitude of said first engine parameter; and (c) comparator means comprising first second and third electrodes, said first electrode connected to said timing capacitor and established at a first electrode voltage varying with said control voltage, said second electrode connected with said reference level generating means to receive said reference level output and established at a second electrode voltage varying with said reference level output, and said output electrode connected to said discharge switch control electrode, said comparator means being operative to compare said first electrode voltage and said second electrode voltage and to generate at said output electrode a third electrode voltage operative to establish said discharge switch means in one of said ON and OFF conditions only when said first electrode voltage is one of a higher and lower voltage in relation to said second electrode voltage and to establish said discharge switch means in the other of said ON and OFF conditions only when said first electrode voltage is in the other of said higher and lower voltage in relation to said second electrode voltage, whereby said comparator means switches said discharge switch between said ON and OFF conditions to vary said control voltage in said opposite direction, said comparator means and said discharge means thereby cooperating to regulate said control voltage in accordance with said reference level output during said first computing portion.

2. The improved initial value establishing circuit of claim 1, wherein said discharge switch means comprise a computing portion switch operative to communicate said comparator means first electrode and said discharge means input electrode only during said first computing portion.

3. In the improved initial value establishing circuit of claim 1 wherein said reference level output comprises a first predetermined output level only when said first engine parameter magnitude exceeds a first predetermined magnitude and a second predetermined output level only when said first engine parameter magnitude is less than said first predetermined magnitude.

4. The improved initial value establishing circuit of claim 3 wherein said first engine parameter comprises engine speed, wherein said successive first and second computing portions each comprise a time duration varying only with engine speed, and wherein said reference level generating means is responsive to said duration of said first computing portion.

5. The improved initial value establishing circuit of claim 11 wherein said reference level generating means are responsive to said duration of said one pulse portion to generate a first reference level output only when said engine speed is greater than a first predetermined speed, a second reference level output less than said first output level when said engine speed is intermediate said first predetermined speed and a second predetermined speed less than said first predetermined speed, and a third reference level output when said speed is less than said second predetermined speed.

6. The improved initial value establishing circuit of claim 5 wherein said discharge switch means comprise first and second discharge switches each having an input electrode connected to said timing capacitor, a control electrode connected with said reference level generating means, and an output electrode connected to said source of reference potential, said first discharge switch control electrode connected to receive said first reference level output and said second discharge switch control electrode connected to receive said second and third reference level outputs, the output electrode of one of said first and second discharge switches being connected to said source of reference potential by a discharge resistor, whereby said one discharge switch when established in said ON condition varies said control voltage at a different rate than the other of said discharge switches when established in the ON condition.

7. In a fuel injection control system of the type wherein a control voltage for determining the duration of the fuel injection command is established by selectively communicating a current from a first energy source to one terminal of a timing capacitor the other terminal of which is connected to a second energy source, a circuit for regulating the control voltage in accordance with reference levels variable within each engine cycle with the varying magnitude of an engine operating parameter comprising:

(a) discharge switch means having input means connected to said timing capacitor, output means connected to a second energy source, and control means operative to establish said discharge switch means in an OFF condition wherein said first energy source is permitted to apply said current to said timing capacitor so as to vary said control voltage in a first direction and alternately in an ON condition wherein said discharge switch means communicates said timing capacitor and said second energy source so as to vary said control voltage in a second direction opposite to said first direction;

(b) reference level generating means responsively communicated with said engine operating parameter to generate a reference level output variable within each engine cycle with the magnitude of said engine operating parameter; and (c) comparator means comprising first input means connected to said timing capacitor, second input means connected to said reference level timing capacitor, second input means connected to said reference level generating means, and output means connected to said control means of said discharge switch means, said comparator means operative to compare voltages at said first and second comparator input means to generate at said comparator output means an output voltage operative to establish said discharge switch means in one of said ON and OFF conditions only when said voltage at said first comparator input means is one of a higher and lower voltage in relation to said voltage at said second comparator input means and to establish said discharge switch means in the other of said ON and OFF conditions only when said first comparator input means voltage is the other of said higher and lower voltage in relation to said second comparator input means voltage, whereby said comparator means cooperates with said discharge switch means to vary said control voltage in said opposite directions so as to regulate said control voltage in accordance with said reference level output.

8. The fuel injection control system of claim 7, wherein said discharge switch means comprise a computing portion switch operative to communicate said comparator first input means and said discharge means input means only during said first computing portion.

9. In the fuel injection control system of claim 7 wherein said reference level output comprises a first predetermined output level only when said first engine parameter magnitude exceeds a first predetermined magnitude and a second predetermined output level only when said first engine parameter magnitude is less than said first predetermined magnitude.

10. The fuel injection control system of claim 9 wherein said first engine parameter comprises engine speed, wherein said successive first and second computing portions each comprise a time duration varying only with engine speed, and wherein said reference level generating means is responsive to said duration of said first computing portion.

11. The fuel injection control system of claim 7 wherein said reference level generating means are responsive to said duration of said one pulse portion to generate said reference level at a first reference level output only when said engine speed is greater than a first predetermined speed, at a second reference level output less than said first output level only when said engine speed is intermediate said first predetermined speed and a second predetermined speed less than said first predetermined speed, and at a third reference level output only when said speed is less than said second predetermined speed.

12. The improved initial value establishing circuit of claim 11 wherein said discharge switch means comprise first and second discharge switches each having an input electrode connected to said timing capacitor, a control electrode connected with said reference level generating means, an output electrode connected to said source of reference potential, and a discharge resistance different for each discharge switch connected in series with the input and output electrode, said first discharge switch control electrode connected to receive said first reference level output and said second discharge switch control electrode connected to receive said second and third reference level outputs, whereby said different resistances cause said control voltage to vary at one rate when one of said discharge switches is established in the ON condition and another rate when the other switch is established in the ON condition.

13. In an internal combustion engine fuel control system of the type having trigger event means operative to generate successive first and second triggering event pulse portions each having a duration varying only with engine speed, computing means responsive to said pulse portions to generate a fuel delivery command signal having a duration indicative of the engine fuel requirements, and fuel supply means responsive to the fuel delivery command to supply the engine with fuel in accordance with the duration of the fuel delivery command, the computing means comprising at least one timing capacitor, first and second current sources for providing respective first and second current to the timing capacitor, and a current source switch operative to communicate the first current source with the timing capacitor during the first triggering event pulse portion and the second source with the timing capacitor during the second trigger event pulse portion, whereby the computing means controls the duration of the fuel delivery command signal in accordance with the time required for a control signal developed by the timing capacitor to vary at a predetermined rate from an initial value determined in accordance with engine speed during the first trigger event pulse portion to a threshold value determined in accordance with an engine air consumption dependent parameter during the second trigger event pulse portion, circuit for regulating the control voltage in accordance with reference levels varying with engine speed comprising:

(a) timing capacitor discharge means comprising first and second discharge switches each having input means, output means, and control means, said input and output means connected respectively to the timing capacitor and to a source of reference potential and comprising a different discharge resistance for each switch, and said control means operative to establish said discharge switch in an OFF condition wherein the first constant current source is permitted to apply the first current to the timing capacitor so as to vary the control voltage in a first direction and alternately in an ON condition wherein said discharge switch communicates the timing capacitor and the source of reference potential so as to vary the control voltage in a second direction opposite to said first direction;

(b) reference level generating means responsive to a said duration of a said first trigger event pulse portion to generate within said pulse portion duration a first reference level only when the engine speed is in a first speed range above a first predetermined speed, a second reference level less than said first reference level when the engine speed is in a second speed range intermediate said first predetermined speed and a second predetermined speed less than said first predetermined speed, and a third reference level when the engine speed is in a third range below said second predetermined speed; and (c) comparator means comprising a first comparator input means connected to the timing capacitor so as to receive said control voltage and first second and third reference comparator switches each having a control electrode connected to said reference level generating means to receive a reference voltage varying respectively with said first second and third reference levels, said first and third comparator reference switches each having an output electrode connected to said first discharge switch control means and said second comparator reference switch having an output electrode connected to said second discharge switch control means, said comparator means operative to compare said control voltage at said first comparator input means with said first and third comparator reference switch reference voltages to establish said first discharge switch in one of said ON and OFF condition only when said control voltage is one of a higher and lower voltage in relation to both said first and third comparator switch reference voltages and to establish said first discharge switch in the other of said ON and OFF conditions only when said control voltage is the other of said higher and lower voltage in relation to both said first and third comparator switch reference voltages and further operative to establish said second discharge switch in one of said ON and OFF conditions only when said control voltage is one of a higher and lower voltage in relation to said second comparator switch reference voltage and to establish said second discharge switch in the other of said ON and OFF conditions only when said control voltage is the other of said higher and lower voltage in relation to said second comparator reference switch reference voltage, whereby said comparator means and discharge means cooperate to alternately vary said control voltage in said first and second opposite directions so as to regulate said control voltage in accordance with said first reference level when the engine speed is greater than said first predetermined speed, in accordance with said second reference level when the engine speed is intermediate the first and second predetermined engine speeds, and in accordance with said third reference level when the engine speed is less than the second predetermined engine speed and whereby said different discharge resistances of said discharge means are operative to vary said control voltage at a first predetermined rate when said engine speed varies between said first and second speed ranges and at a second predetermined range when said speed varies between said second and third range.

* * * * *